US006336575B1

(12) United States Patent
Schemeit et al.

(10) Patent No.: US 6,336,575 B1
(45) Date of Patent: Jan. 8, 2002

(54) SUBMERGED NOZZLE FOR SLAB CONTINUOUS CASTING MOULDS

(75) Inventors: Hans Jürgen Schemeit, Langenfeld; Ulrich Urlau, Moers, both of (DE)

(73) Assignee: Mannesmann AG, Düsseldorf (DE)

( * ) Notice: Subject to any disclaimer, the term of this patent is extended or adjusted under 35 U.S.C. 154(b) by 0 days.

(21) Appl. No.: 09/424,680

(22) PCT Filed: May 20, 1998

(86) PCT No.: PCT/DE98/01438

§ 371 Date: Nov. 29, 1999

§ 102(e) Date: Nov. 29, 1999

(87) PCT Pub. No.: WO98/53938

PCT Pub. Date: Dec. 3, 1998

(30) Foreign Application Priority Data

May 28, 1997 (DE) ..... 197 22 890

(51) Int. Cl.[7] ..... B22D 41/08
(52) U.S. Cl. ..... 222/594; 222/606
(58) Field of Search ..... 222/591, 594, 222/606, 607

(56) References Cited

U.S. PATENT DOCUMENTS 4,220,618 A * 9/1980 Pierson et al.
5,501,430 A * 3/1996 Yamaoka et al. ..... 222/606

FOREIGN PATENT DOCUMENTS

CH 570217 A * 10/1975
DE 2358339 B * 8/1974
EP 0648561 A * 4/1995

OTHER PUBLICATIONS

Patent Abstracts of Japan, JP 63 130257 A, Jun. 1988.*

* cited by examiner

*Primary Examiner*—Scott Kastler
(74) *Attorney, Agent, or Firm*—Cohen, Pontani, Lieberman & Pavane

(57) ABSTRACT

An immersion nozzle of a metallurgic vessel which is arranged upstream of a continuous casting mold and which is constructed as a single-piece structural component part and has, in the mouth area, a slit-shaped pour-out opening whose length is several times greater than its width. The immersion nozzle has a cylindrical shape with a circular, oval, or bone-shaped cross-sectional shape, and the slit-shaped pour-out opening is constructed as a continuous slit extending in the base and the side wall of the cylindrical part of the immersion nozzle.

9 Claims, 4 Drawing Sheets

Fig.1.1 a)
(B-B)
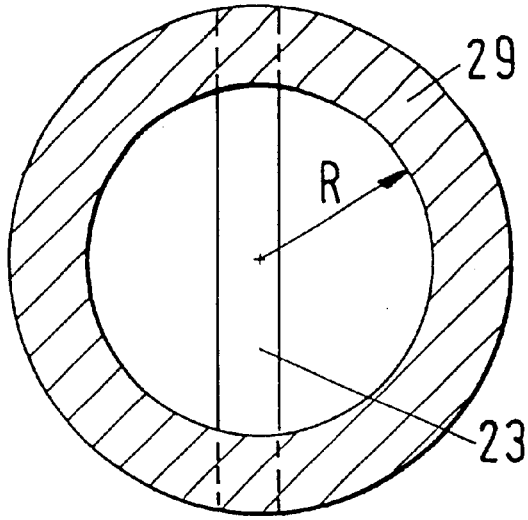
b)
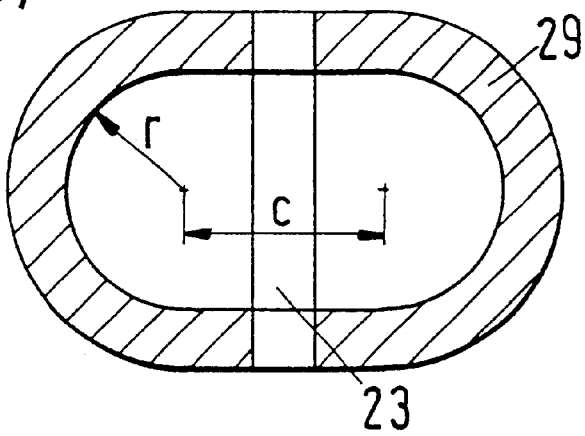
c)
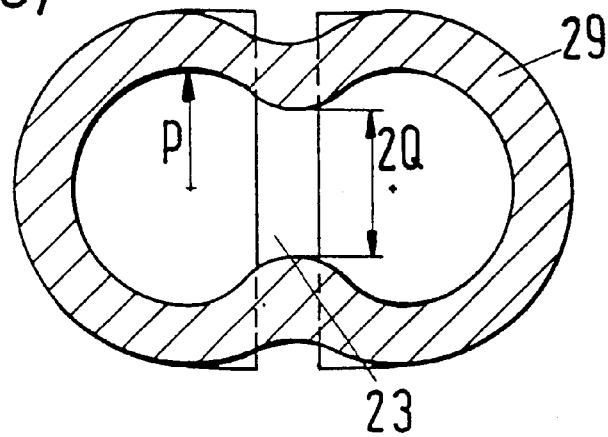

(A-A)

(C-D)

(A-A)

SUBMERGED NOZZLE FOR SLAB CONTINUOUS CASTING MOULDS

This application is a 371 of PCT/DE98/01438, filed on May 20, 1998.

BACKGROUND OF THE INVENTION

1. Field of the Invention

The invention is directed to an immersion nozzle of a metallurgic vessel which is arranged upstream of a continuous casting mold and which is constructed as a single-piece structural component part and has, in the mouth area, a slit-shaped pour-out opening whose length is several times greater than its width. The invention further relates to a method for producing an immersion nozzle of this type.

2. Discussion of the Prior Art

DE 37 09 188 C2 discloses an immersion nozzle for continuous casting molds which comprises at least two structural component parts, wherein the part projecting into the continuous casting mold is narrow in a plane perpendicular thereto and, in this respect, has a length-to-width ratio of 20:1 to 80:1.

Both the upper and lower longitudinal portions must be produced in a costly manner with special core segments which can be divided in this location.

DE-OS 24 28 060 discloses a continuous method for the continuous casting of steel in which steel is guided via a pour pipe into a substantially rectangular mold. The pour pipe has lateral outlet openings which are directed downward.

It is disadvantageous that a flow divider is provided in the center of the mouth and, in case of the slightest irregularities, the flow of steel is deflected by the flow divider preferably in one direction and, moreover, a central flow-in of the steel is prevented.

U.S. Pat. No. 3,991,815 discloses a pour pipe or casting tube which has, in the mouth area, a bottleneck-shaped narrowing and bore holes which are directed toward the rear at the sides adjacent to the central flow-out opening. This submerged casting tube, which is essentially provided for billet plants, disadvantageously divides the flow into three mutually independent individual flows.

SUMMARY OF THE INVENTION

It is the object of the invention to provide an immersion nozzle for a continuous slab casting plant which has a simply designed construction and long life and which guides the molten metal into a continuous slab casting mold with low turbulence and penetration depth, as well as a method for producing an immersion nozzle of this type.

According to the invention, the immersion nozzle which is constructed as a cylinder, has a continuous slit in its base which extends into the side wall. The cross-sectional shape of the cylinder can be circular, oval, or bone-shaped, i.e., oval with a bulge.

The base of the cylindrical immersion nozzle is dish-shaped or is beveled and accordingly terminates in a wedge-shaped manner in the direction of the slit.

The slit has side walls which are basically arranged so as to extend parallel to one another in a straight-line. In an advantageous embodiment, the slit-shaped pour-out opening is wedge-shaped with the large opening in the center of the slit. In a further embodiment, the slit-shaped pour-out opening is wider in the area of the side wall than in the center of the mouth. The shape of the side wall follows a curved shape having turning or inflection points in the area of the base at both sides of the center axis. In a particularly advantageous construction, the extension of the slit in the side walls is changeable. The change in length can be achieved gradually by means of insert pieces which can be inserted in the base of the slit.

A continuous change in the slit length is achieved by means of a sleeve which encloses the immersion nozzle in a displaceable manner. In this respect, the length of the sleeve is either dimensioned so as to be so short that the sleeve is completely immersed in the melt or, in another construction, the sleeve has a length which extends until close to the metallurgic vessel at one end, wherein sealing means are provided between the sleeve and the submerged nozzle in order to prevent a flow of unwanted air into the liquid melt.

In order to influence the slit length at both ends of the slit, the sleeve is beveled at its mouth end and is constructed so as to be rotatable in addition to the axial displacement.

The production of the body can be influenced in a particular way by means of the especially simple shape of the immersion nozzle with its cylindrical wall.

According to the invention, during the production of an immersion nozzle the outer shape body or outer mold body is oriented upward by the end to be fastened subsequently to the metallurgic vessel. A plate is inserted in the base area corresponding to the intended slit. The negative shapes for the subsequent base shape, namely, the dish base or wedge, are already present in the outer mold body or can be added as a structural component part.

The core is inserted into the cavity from the top in conformity to dimensions. After the core is fixed, the refractory material is introduced and correspondingly treated, that is, substantially solidified. Taking into account a required conicity, or amount of taper, in the basic cylindrical shape of the immersion nozzle, the core as well as the outer mold body can be removed from the finished immersion nozzle in a simple manner.

Due to the construction of the base with the continuous slit as suggested according to the invention, the liquid melt exits the immersion nozzle during operation in a shape and at a speed which allows a particularly small penetration of the fed melt into the melt already located in the mold. In this way, only very slight turbulence occurs. The melt volumes are unified in a particularly short time and flow in a piston-shaped or bulb-shaped stream at the predetermined take-off speed in the steel strand surrounded by the strand shell.

The immersion nozzle arranged in front is suitable for slabs and billets because the melt exiting from the immersion nozzle has only a low kinetic energy. The melt exiting the immersion nozzle from the slit spreads out in a cloudlike manner with only a small penetration depth in all directions.

After flowing a short distance, the fresh melt flowing into the crater assumes the shape of a bulb flow and this has positive effects on the quality of the product, especially on the purity of the steel. Further, the homogeneity is improved and impurities are reduced.

The steel generated in this way has an especially high degree of purity.

Another result of the small penetration depth in the crater is the possibility that only a short mixing length is caused in case of a change in quality during pouring on the continuous casting plant, so that only a short piece of slab steel of unwanted quality is generated.

An example of the invention is shown in the accompanying drawings.

BRIEF DESCRIPTION OF THE DRAWINGS

FIGS. 1.1*a, b,* and *c* show section BB at the immersion nozzle.

DETAILED DESCRIPTION OF THE PREFERRED EMBODIMENTS

Figure 1:
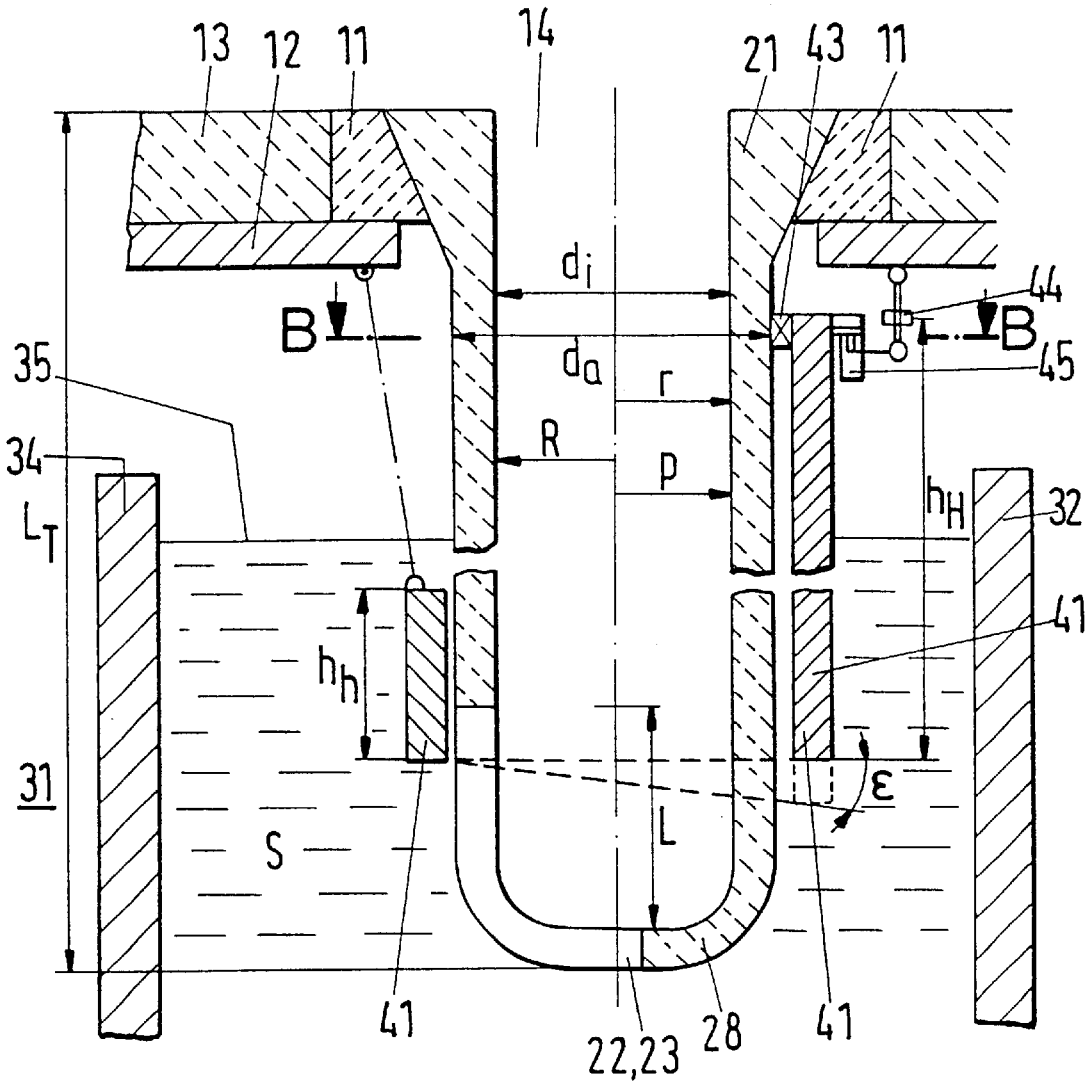
FIG. 1 shows a section through an immersion nozzle.

A section through the immersion nozzle is shown in the upper part of FIG. 1. The metal casing 12 and refractory lining 13 of the melt vessel 11 are only indicated as a detail. A perforated block through which an immersion nozzle 21 is guided is provided in the area of the outlet opening 14.

The immersion nozzle 21 has, a side wall 29 and a base 28. In the base 28, a pour-out opening 22 is constructed as a slit 23. In FIG. 1, a section through the slit 23 is shown on the upper left-hand side and a view through the slit 23 is shown on the right-hand side.

The immersion nozzle 21 is surrounded by a sleeve 41. In the left-hand part of the drawing, the sleeve 41 has a relatively short length ($h_h$), so that the sleeve 41 is completely immersed in the melt S of the mold 31 during operation. The mold 31 has a broad side 32 and a narrow side 34 and can be filled with melt S up to a level 35.

In the right-hand part of FIG. 1, the sleeve 41 has a length $h_H$ and accordingly projects out of the liquid melts.

Sealing means 43 are provided at the front end of the sleeve 41. The sealing means 43 contact the outer wall of the immersion nozzle 21 and allow a displacement of the sleeve 41 relative to the immersion nozzle.

There are arranged at the sleeve 41 a displacing device 44 and a rotating device 45, by means of which the sleeve 41 can be moved into a desired position relative to the immersion nozzle 21.

The sleeve 41 is beveled at the mouth end at an angle $\epsilon$. By rotating the sleeve, both slit ends can be changed in length to a predeterminable degree.

FIG. 1.1 shows section BB of the immersion, nozzel 21 in FIG. 1, wherein a) shows a circular cross section of radius R, b) shows a circular-oval cross section, i.e., an oval with two semi-circles of radius whose center points are arranged at a distance c and whose longitudinal side walls are guided parallel to one another and contact the half-circles tangentially, and c) shows a bone-shaped cross section, that is, an oval cross section with an indentation with spacing 2Q, that is, equal to the diameter of the circle portions with radius p.

While the slit arrangement is optional with respect to the circular cylinder, it is guided by the parallel side walls in the circular-oval immersion nozzle in example b). In the bone-shaped construction, the slit is provided in the area of contact between the two circle parts.

Figure 2:
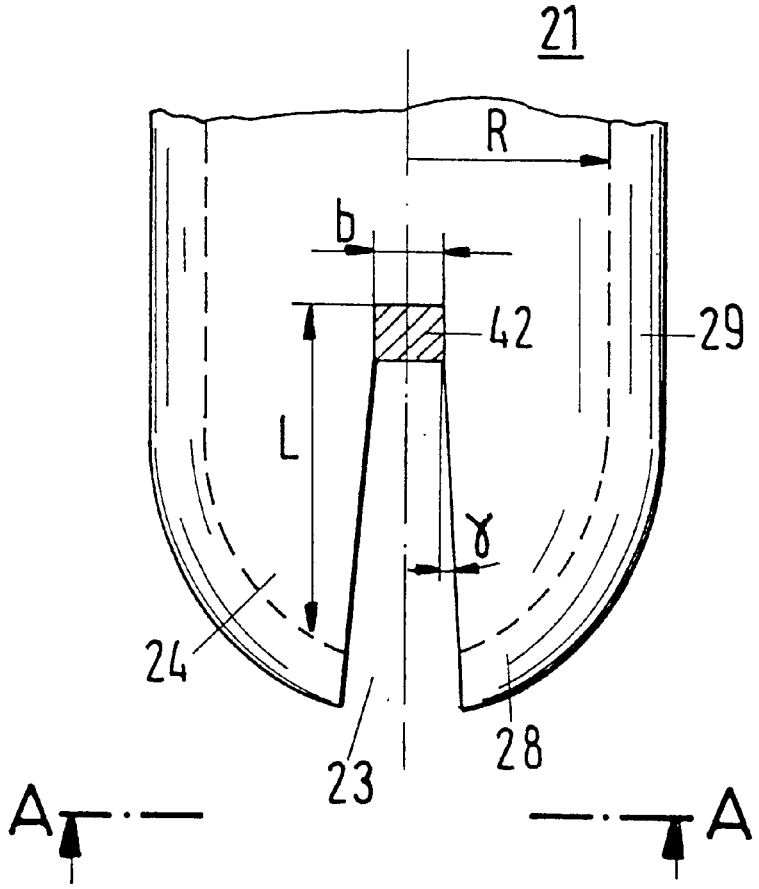
FIG. 2 shows a dish base.
Figure 2:
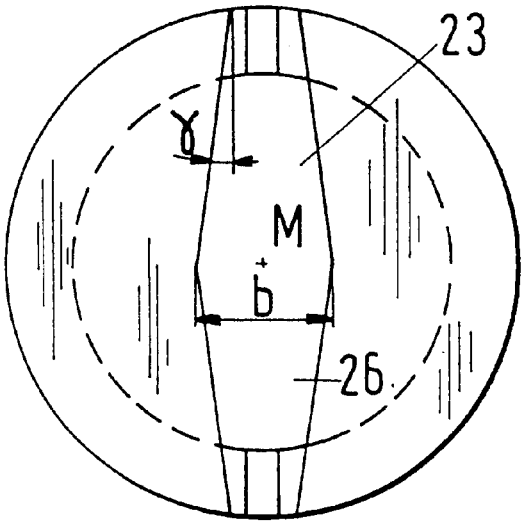

In FIG. 2, the base 28 of the immersion nozzle 21 is dish-shaped, resulting in hollow sphere quarters 24 on either side of the slit 23.

The slit has a length L and, at its base, a width b. Width b can be zero insofar as the slit 23 opens conically in the direction of the mouth at an angle $\gamma$.

In the present case, an insert piece 42 by which the slit length L can be reduced gradually is introduced in the base of the slit 23.

View AA is shown in the lower part of FIG. 2. In the area of the mouth center M, the slit 26 has a widening 26 with its maximum width b in the mouth center M.

Figure 3:
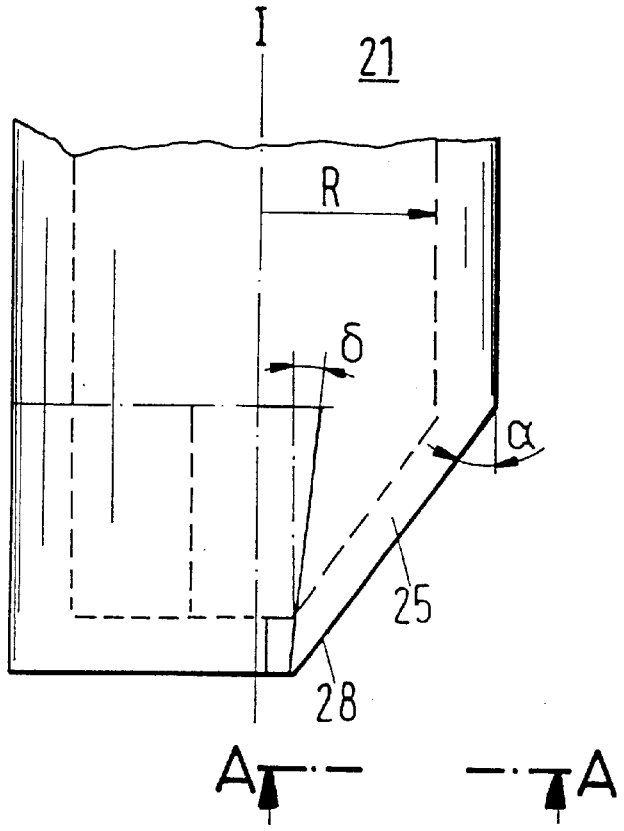
FIG. 3 shows a wedge-shaped base.
Figure 3:
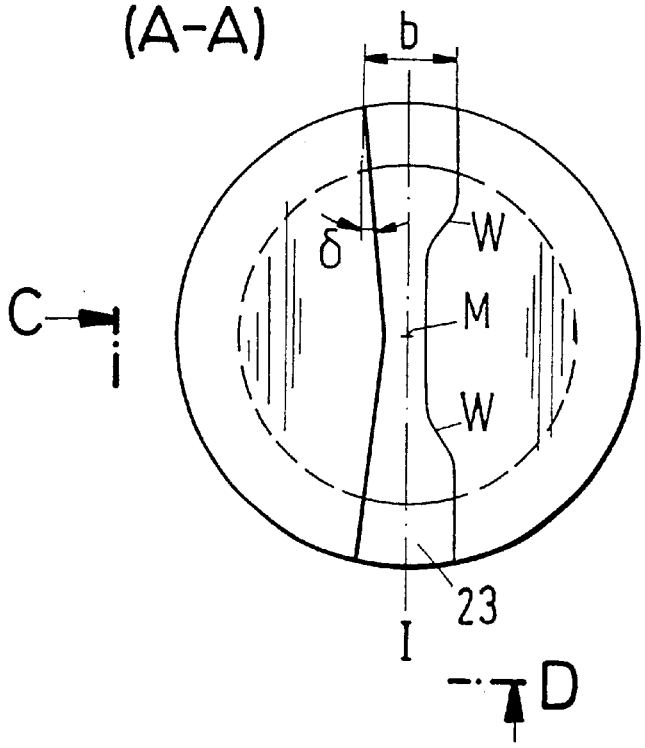

FIG. 3 shows an immersion nozzle 21 which is constructed as a wedge in the mouth area. The base 28 shows a view of the inclination 25 sloping at an angle $\alpha$ to the center axis I. View c) is shown at the upper left-hand side of the drawing with a view toward the inclination 25 of the base 28.

FIG. 3 shows, at the bottom, view AA with a slit 23 which narrows toward the center M. The taper is guided in a straight line at an angle $\delta$ to the center axis I in the left-hand part of the drawing. In the right-hand part of the drawing, the contour extends in a curved manner and has inflection points W at either side of the center point.

What is claimed is:

1. An immersion nozzle of a metallurgic vessel which is arranged upstream of a continuous casting mold and which is constructed as a single-piece structural component part, comprising a mouth area with a slit-shaped pour-out opening whose length is several times greater than its width, the immersion nozzle having a base and a side wall, and a cylindrical shape with one of a circular, oval and bone-shaped cross-sectional shape, the slit-shape pour-out opening being a continuous slit extending in the base and the side wall, the base being one of: dish-shaped and formed of two hollow sphere quarters which are arranged on either side of the slit-shaped opening; and leveled at both sides of the slit-shaped opening and having inclinations inclined toward a principal axis at an angle $\alpha$, where $\alpha$=from 30 to 70°, the slit-shaped opening having at least one area with a width (b), where b=0.075 to 0.15× radius, the slit-shaped opening having one of a widening and narrowing in a mouth center with a width different than width (b), and further comprising a sleeve arranged to surround the immersion nozzle, the sleeve having a height greater than $0.5 \cdot d_a$, where $d_a$ is an outer diameter of the immersion nozzle, and means for displacing the sleeve so that a part of slit areas extending in the side wall of the immersion nozzle can be covered.

2. An immersion nozzle according to claim 1, wherein the slit-shaped opening has a widening in the center of the mouth of the immersion nozzle, the widening being notch-shaped and having a widening angle $\gamma$, where $\gamma$=3 to 12°.

3. An immersion nozzle according to claim 1, wherein the slit-shaped opening has a narrowing in the mouth center with slit edges oriented relative to one another in a cone-shaped manner at an angle where $\delta$<8°.

4. An immersion nozzle according to claim 2, wherein the widening follows a curve shape having an inflection point.

5. An immersion nozzle according to claim 3, wherein the narrowing follows a curve shape having an inflection point.

6. Immersion nozzle according to claim 1, wherein the slit-shaped opening in the side wall of the immersion nozzle extends to a length (L) from the mouth center, where L =0.2 to $0.7 \cdot d_i$, where $d_i$=2×R=inner diameter.

7. An immersion nozzle according to claim 1, wherein the sleeve has a length which substantially corresponds to the length of the immersion nozzle, which immersion nozzle length is reduced by slit length, and further comprising means provided between an outer wall of the immersion nozzle and an inner wall of the sleeve for sealing.

8. An immersion nozzle according to claim 1, wherein the sleeve has a mouth that is beveled at an angle of inclination $\epsilon$=5 to 20°, the sleeve being rotatable about its principal axis.

9. An immersion nozzle according to claim 1, wherein insert pieces are inserted into the base of the slit.

* * * * *